US012082702B1

(12) United States Patent
Tang

(10) Patent No.: US 12,082,702 B1
(45) Date of Patent: Sep. 10, 2024

(54) INFLATABLE BED WITH MESH-SHAPED INCLINED DIAPHRAGM

(71) Applicant: WUZHOU BAOFENG PLASTIC PRODUCTS CO., LTD., Wuzhou (CN)

(72) Inventor: Xiaosan Tang, Chongqing (CN)

(73) Assignee: WUZHOU BAOFENG PLASTIC PRODUCTS CO., LTD., Wuzhou (CN)

( * ) Notice: Subject to any disclaimer, the term of this patent is extended or adjusted under 35 U.S.C. 154(b) by 0 days.

(21) Appl. No.: 18/544,596

(22) Filed: Dec. 19, 2023

(30) Foreign Application Priority Data

Jul. 29, 2023 (CN) ..... 202322051868.1

(51) Int. Cl.
*A47C 27/08* (2006.01)
*A47C 27/00* (2006.01)

(52) U.S. Cl.
CPC ..... *A47C 27/081* (2013.01); *A47C 27/087* (2013.01); *A47C 27/08* (2013.01)

(58) Field of Classification Search
CPC ..... A47C 27/082; A47C 27/087; A47C 27/08; A47C 27/081; A47C 27/10
USPC ..... 5/710–713, 706, 644, 654, 655.3
See application file for complete search history.

(56) References Cited

U.S. PATENT DOCUMENTS 7,089,618 B1 * 8/2006 Metzger ..... A47C 27/087 5/709
7,353,555 B2 * 4/2008 Lau ..... A47C 27/081 5/711
9,247,827 B2 * 2/2016 Lin ..... A47C 27/081
10,398,235 B2 * 9/2019 Lin ..... A47C 27/10
10,631,659 B2 * 4/2020 Xia ..... B29C 66/1122
10,687,633 B2 * 6/2020 Liu ..... A47C 27/087
11,330,914 B2 * 5/2022 Ocegueda Gallaga ..... B29C 66/433
11,564,505 B2 * 1/2023 Liu ..... A47C 27/16
11,641,948 B2 * 5/2023 Huang ..... A47C 27/081 5/706
11,964,460 B1 * 4/2024 Xia ..... B32B 1/00
2007/0124864 A1 * 6/2007 Lau ..... A47C 27/081 5/711
2015/0096126 A1 * 4/2015 Chai ..... A47C 27/087 5/706
2015/0201760 A1 * 7/2015 Lin ..... A47C 27/087 5/710
2015/0335164 A1 * 11/2015 Liu ..... F24F 1/022 156/278

(Continued)

FOREIGN PATENT DOCUMENTS

EP 3031363 A1 * 6/2016 ..... A47C 27/081
EP 3031363 B1 * 10/2017 ..... A47C 27/081

(Continued)

*Primary Examiner* — Robert G Santos
(74) *Attorney, Agent, or Firm* — Cooper Legal Group, LLC

(57) ABSTRACT

An inflatable bed with a mesh-shaped inclined diaphragm includes a side panel, the mesh-shaped inclined diaphragm and two face layers symmetrically arranged, a first end of the side panel is connected to a periphery of a first face layer of the two face layers, a second end of the side panel is connected to a periphery of a second face layer of the two face layers, a first end of the mesh-shaped inclined diaphragm is connected to the side panel, and a second end of the mesh-shaped inclined diaphragm is connected to one of the two face layers.

7 Claims, 7 Drawing Sheets

(56) References Cited

U.S. PATENT DOCUMENTS

| | | | | |
|---|---|---|---|---|
| 2016/0183692 | A1* | 6/2016 | Lin | A47C 27/081 5/710 |
| 2017/0196368 | A1* | 7/2017 | Liu | A47C 27/16 |
| 2017/0215599 | A2* | 8/2017 | Lin | A47C 27/10 |
| 2017/0238718 | A1* | 8/2017 | Xia | B29C 65/04 |
| 2020/0187668 | A1* | 6/2020 | Ocegueda Gallaga | A47C 27/087 |
| 2020/0315366 | A1* | 10/2020 | Liu | A47C 27/16 |
| 2021/0169232 | A1* | 6/2021 | Hou | A47C 27/087 |
| 2021/0196053 | A1* | 7/2021 | Li | A47C 27/10 |
| 2022/0125212 | A1* | 4/2022 | Huang | A47C 27/087 |
| 2022/0273116 | A1* | 9/2022 | Ocegueda Gallaga | A47C 27/081 |
| 2024/0092068 | A1* | 3/2024 | Shi | B32B 27/36 |

FOREIGN PATENT DOCUMENTS

| | | | | |
|---|---|---|---|---|
| WO | WO-2015023932 | A1 * | 2/2015 | A47C 27/087 |
| WO | WO-2020128924 | A1 * | 6/2020 | A47C 27/081 |

* cited by examiner

INFLATABLE BED WITH MESH-SHAPED INCLINED DIAPHRAGM

CROSS-REFERENCE TO RELATED APPLICATION

This application is based on and claims the priority benefit of Chinese patent application serial no. 202322051868.1, filed on Jul. 29, 2023. The entirety of Chinese patent application serial no. 202322051868.1 is hereby incorporated by reference herein and made a part of this specification.

TECHNICAL FIELD

The present application relates to a technical field of inflatable bed, and in particular, to an inflatable bed with a mesh-shaped inclined diaphragm.

BACKGROUND ART

The inflatable bed is widely loved by consumers because the inflatable bed possesses a small size and is easy to be folded and carried in the deflating state, and possesses a light weight and is easy to be moved and be placed in the inflating state. The inflatable bed is suitable for home visitors, office nap, outdoor camping and other occasions.

At present, inflatable beds are generally provided with an inclined drawing strap around the periphery of the internal wall. One side of the inclined drawing strap is connected to the periphery of the top of the inflatable bed and the other side is connected to the periphery of the side panel of the inflatable bed, such that the inclined drawings strap pulls, fixes and reinforces the joint between the surface and the side panel of the inflatable bed after being inflated, improving the stability of the inflatable bed. In the existing inflatable bed with inclined drawing strap, the inclined drawing strap must be configured with holes, or the inflating and deflating assembly is provided with connecting pipes in communication with the inclined drawing strap, such that the inflated air can flow into the cavity enclosed by the top surface, the side panel and the inclined drawing strap during inflating, to ensure that the gas can be filled to various parts of the inflatable bed.

In the above related technologies mentioned, punching of the sheet-shaped inclined drawing strap will increase the production processes and lower the production efficiency, and when the inflatable bed is deflated, is folded and stored, the sheet-shaped inclined drawing strap is stacked in the inside of the inflatable bed, which increases the thickness of the inflatable bed after being deflated, thereby being not conducive to be folded and stored. In the case that the inflatable bed is forcibly folded, the stacked sheet-shaped inclined drawing strap would be deformed. When the inflatable bed is inflated again and the sheet-shaped inclined drawing strap stacked in the inside of the inflatable bed is unfolded again, the drawing stability of the sheet-shaped inclined drawing strap being stacked and squeezed to be deformed is reduced, and the stability of the inflatable bed is reduced. In addition, the connecting pipes are added to the inner structure of the inflatable bed, which leads to a heavier weight of the inflatable bed, and is not conducive to be folded, stored and carried.

SUMMARY

In order to avoid the lowered production efficiency due to punching of the sheet-shaped inclined drawings strap, the heavier weight and easy deformation of the inflatable bed during folding and storing due to the sheet-shaped inclined drawing strap, an inflatable bed with mesh-shaped inclined diaphragm is disclosed.

The inflatable bed with a mesh-shaped inclined diaphragm disclosed adopts the following technical solutions.

An inflatable bed with a mesh-shaped inclined diaphragm includes a side panel and two face layers symmetrically arranged, a first end of the side panel is connected to a periphery of a first face layer of the two face layers, a second end of the side panel is connected to a periphery of a second face layer of the two face layers, wherein the inflatable bed with a mesh-shaped inclined diaphragm further includes the mesh-shaped inclined diaphragm, a first end of the mesh-shaped inclined diaphragm is connected to the side panel, and a second end of the mesh-shaped inclined diaphragm is connected to one of the two face layers.

By adopting the above technical solution, fiber is woven into a mesh-shape during preparation, which has a plurality of mesh-holes, the material of the inclined drawings strap is greatly reduced and the weight of the inflatable bed is reduced compared with the traditional sheet-shaped inclined drawing strap. The flexibility of the inclined diaphragm can be improved through the mesh-holes of the inclined diaphragm, so that the inflatable bed is easy to be folded and stored and the vertical drawing strap is not easy to deform after being folded and stored, which can remain a good stability after being inflated again. In addition, the mesh-holes of the mesh-shaped inclined diaphragm improves the airflow fluidity inside the inflatable bed and in turn the inflating efficiency of the inflatable bed, such that the traditional punching process of the inclined drawing strap can be saved, thereby increasing the production efficiency.

Optionally, the quantity of the mesh-shaped inclined diaphragm is one, the first end of the mesh-shaped inclined diaphragm is connected to the side panel, and the second end of the mesh-shaped inclined diaphragm is connected to one of the two face layers.

By adopting the above technical solution, the mesh-shaped inclined diaphragm can be arranged at the top or bottom of the inflatable bed, so that the weight of the inflatable bed is reduced, and that the side panel of the inflatable bed has a two-layer structure in appearance, which is adapted to a relative short inflatable bed, thereby possessing an excellent stability. In addition, the above technical solution can also be used for an inflatable bed with a bed structure with the mesh-shaped inclined diaphragm at the top and a sheet-shaped inclined diaphragm at the bottom thereof, or a bed structure with the sheet-shaped inclined diaphragm at the top and the mesh-shaped inclined diaphragm at the bottom thereof.

Optionally, two mesh-shaped inclined diaphragms are provided, the first end of a first mesh-shaped inclined diaphragm of the two mesh-shaped inclined diaphragms is connected to the side panel, the second end of the first mesh-shaped inclined diaphragm of the two mesh-shaped inclined diaphragms is connected to the first face layer; the first end of a second mesh-shaped inclined diaphragm of the two mesh-shaped inclined diaphragms is connected to the side panel, and the second end of the second mesh-shaped inclined diaphragm of the two mesh-shaped inclined diaphragms is connected to the second face layer.

By adopting the above technical solution, the inflatable bed is provided with the mesh-shaped inclined diaphragms both at the top and at the bottom thereof, which greatly reduces the weight of the inflatable bed, improves the airflow fluidity inside the inflatable bed and in turn the inflating efficiency of the inflatable bed, and saves the punching process of the inclined diaphragm.

Optionally, the inflatable bed with mesh-shaped inclined diaphragm further includes a first reinforcing sheet, the first reinforcing sheet is connected to an inner surface of the side panel, and a first lateral edge of the mesh-shaped inclined diaphragm is arranged between the first reinforcing sheet and the inner surface of the side panel.

By adopting the above technical solution, the connection stability between the mesh-shaped inclined diaphragm and the side panel can be improved, such that the mesh-shaped inclined diaphragm is not easy to separate from the inner surface of the side panel after deflating, folding inflating and using for many times, thereby possessing a good structure stability, which is adapted to the inflatable bed with one mesh-shaped inclined diaphragm or two mesh-shaped inclined diaphragms.

Optionally, the inflatable bed with mesh-shaped inclined diaphragm further includes a second reinforcing sheet, the second reinforcing sheet is connected to an inner surface of a respective one of the two face layers, and a second lateral edge of the mesh-shaped inclined diaphragm is arranged between the second reinforcing sheet and the inner surface of the respective one of the two face layers.

By adopting the above technical solution, the connection stability between the mesh-shaped inclined diaphragm and the side panel can be improved, such that the mesh-shaped inclined diaphragm is not easy to separate from the inner surface of the face layer after deflating, folding inflating and using for many times, thereby possessing a good structure stability, which is adapted to the inflatable bed with one mesh-shaped inclined diaphragm or two mesh-shaped inclined diaphragms.

Optionally, a width of the first reinforcing sheet and the second reinforcing sheet is 0.2-20 cm, preferably 0.5-5 cm, 1-4 cm, 2-3 cm, and further preferably, can be 0.2 cm, 0.4 cm, 0.5 cm, 0.6 cm, 0.8 cm, 1.0 cm, 1.2 cm, 1.5 cm, 1.8 cm, 2.0 cm, 2.2 cm, 2.5 cm, 2.8 cm, 3.0 cm, 3.2 cm, 3.5 cm, 3.8 cm, 4.0 cm, 4.2 cm, 4.5 cm, 4.8 cm, 5.0 cm, 5.2 cm, 5.5 cm, 5.8 cm, 6.0 cm, 8.0 cm, 10.0 cm, 12.0 cm, 14.0 cm, 15.0 cm, 16.0 cm, 18.0 cm, or 20.0 cm or other sizes.

Optionally, the first and second reinforcing sheets each include at least one adhesive layer, in particular, the adhesive layer is a glue layer or a PVC layer, and the glue layer can be made of a hot-melt adhesive or other glue materials except the hot-melt adhesive. Preferably, the first reinforcing sheet includes an adhesive layer and a cloth layer, the adhesive layer is arranged on the surface of the cloth layer, and a side face of the adhesive layer facing away from the cloth layer is connected to the connection of the mesh-shaped inclined diaphragm. When the adhesive layer is a glue layer or a PVC layer, the hot-melt adhesive or other glue material or the PVC after being melted flows in the mesh-holes at the connection between the mesh-shaped inclined diaphragm and the side panel, and is connected to the inner surface of the side panel. The side panel, the connection of the mesh-shaped inclined diaphragm and the first reinforcing sheet are connected to each other after the glue layer or the PVC layer is cured. Similarly, the second reinforcing sheet includes an adhesive layer and a cloth layer, too, the adhesive layer is arranged on the surface of the cloth layer, and a side face of the adhesive layer facing away from the cloth layer is connected to the connection of the mesh-shaped inclined diaphragm. When the adhesive layer is a glue layer or a PVC layer, the hot-melt adhesive or other glue material or the PVC after being melted flows in the mesh-holes at the connection between the mesh-shaped inclined diaphragm and the face layer, and is connected to the inner surface of the face layer. The face layer, the connection of the mesh-shaped inclined diaphragm and the second reinforcing sheet are connected to each other after the glue layer or the PVC layer is cured Optionally, at least one of the side panel or the face layers is provided with an inflating and deflating assembly.

By adopting the above solution, the inflatable bed can be quickly inflated and deflated, the inflating and deflating assembly can be an inflating and deflating mouth that inflates and deflates air via an inflating tube and an external inflating pump; and the inflating and deflating assembly can be a micropump for inflation and deflation, which is conducive to be carried, and carry out inflation and deflation any time.

Optionally, a mesh-hole density of the mesh-shaped inclined diaphragm is 10-1000 mesh-holes/$dm^2$.

By adopting the above solution, the mesh-shaped inclined diaphragm possesses a good flexibility, a good strength, and a good gas permeability. After multiple inflation and deflation, the mesh-shaped inclined diaphragm can still be stably connected to the face layer and the side panel, which can reduce the weight of the inflatable bed, and can reduce the thickness of the inflatable bed when the inflatable bed is deflated, folded and stored.

Optionally, the mesh-shaped inclined diaphragm is produced by cutting meshes woven by a modified polyester fiber, the modified polyester fiber is made by melting and spinning a modified polyester fiber masterbatch, the modified polyester fiber masterbatch is made of following raw materials in parts by weight: 55-70 parts of the polyester masterbatch; 8-12 parts of a polyamide-6; 5-8 parts of an ethylene-methyl acrylate copolymer, 3-6 parts of a nano silica, 1-3 parts of a nano zinc oxide, and 2-3 parts of a cation dispersant.

By adopting the above technical solution, the prepared modified polyester fiber has a low elasticity, a light weight, and a good wear-resistance, and the mesh-shaped inclined diaphragm woven can be stably connected to two face layers and the side panel. Specifically, the tensile strength and the flexibility of the modified polyester fiber are improved by adding the polyamide-6, such that the modified polyester fiber has a flexibility and a bending performance while resisting wrinkles. When the inflatable bed is inflated and used for many times, the mesh-shaped inclined diaphragm is drawn by the face layer and the side panel, the mesh-shaped inclined diaphragm is not easy to deform or break, and the stability thereof is good. When the inflatable bed is deflated to be folded, the mesh-shaped inclined diaphragm is folded inside the inflatable bed, and is not easy to form a crease. When the inflatable bed is inflated and used again, a stable connection and drawing function can be maintained by the mesh-shaped inclined diaphragm.

In particular, the nano silica and the nano zinc oxide can improve the strength of the polyester fiber, at same time, can improve the dispersibility of the polyester masterbatch and the polyamide-6 under the effect of the cation dispersant in combination with the nano morphology of the nanofillers, and can improve the compatibility between the polyester masterbatch and the polyamide-6 in combination with the ethylene-methyl acrylate copolymer, such that the modified polyester fiber has a uniform strength and toughness, to avoid the following situation: the modified polyester fiber is easy to break due to a relatively low strength of a certain section of the polyester fiber, which leads to uneven stress of the mesh woven by fiber of the mesh-shaped inclined diaphragm, thereby affecting the connection and the drawing function of the face layer and the side panel.

In summary, at least one of the following beneficial technical effects is achieved:

1. Through the mesh-shaped inclined diaphragm of the present disclosure, compared with the traditional sheet-shaped inclined drawing strap, material of the inclined drawings strap is greatly reduced and the weight of the inflatable bed is reduced. The flexibility of the inclined diaphragm can be improved through the mesh-holes of the inclined diaphragm, so that the inflatable bed is easy to be folded and stored, and that the vertical drawing strap is not easy to deform after being folded and stored, which can remain a good stability after being inflated again. In addition, the mesh-holes of the mesh-shaped inclined diaphragm improves the airflow fluidity inside the inflatable bed and in turn the inflating efficiency of the inflatable bed, such that the traditional punching process of the inclined drawing strap can be saved, thereby increasing the production efficiency.

2. The first reinforcing sheet and the second reinforcing sheet are provided, such that the connection stability between the mesh-shaped inclined diaphragm and the side panel and the face layer can be improved, such that the mesh-shaped inclined diaphragm is not easy to separate from the inner surface of the face layer and of the side panel after deflating, folding, inflating and using for many times, thereby improving the structure stability.

DETAILED DESCRIPTION

The present application is further described in detail below in combination with FIGS. 1-19.

An inflatable bed with a mesh-shaped inclined diaphragm is disclosed.

Example 1

Figure 1:
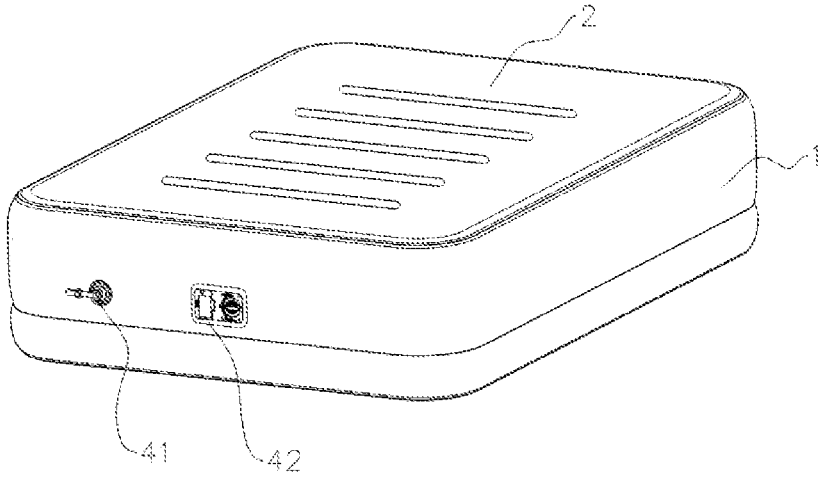
FIG. 1 is a perspective schematic view of the inflatable bed with mesh-shaped inclined diaphragm according to Example 1 of the present application.
Figure 2:
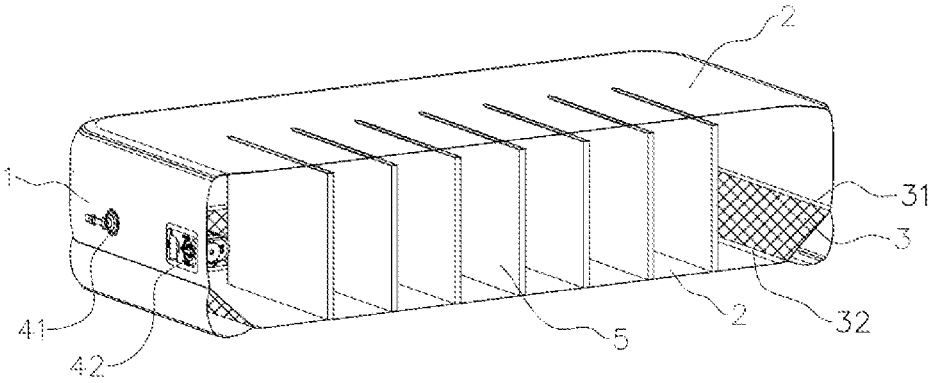
FIG. 2 schematically shows a cross-sectional view of the sheet-shaped vertical drawing strap extending along the width direction of the inflatable bed according to Example 1 of the present application.

Referring to FIGS. 1 and 2, an inflatable bed with a mesh-shaped inclined diaphragm includes a side panel 1, a mesh-shaped inclined diaphragm 3, a plurality of vertical drawing straps 5, two face layers 2 symmetrically arranged at the top and bottom of the side panel 1, the top of the side panel 1 is connected to the periphery of one face layer 2, and the bottom of the side panel 1 is connected to the periphery of the other face layer 2, which enclose an inflatable cavity. The side panel 1 or the face layer 2 is provided with an inflating and deflating assembly, or the side panel 1 and the face layer 2 are both provided with the inflating and deflating assembly. The top of each vertical drawing strap 5 is connected to the face layer 2 at the top of the side panel 1, and the bottom of each vertical drawing strap 5 is connected to the face layer 2 at the bottom of the side panel 1. The mesh-shaped inclined diaphragm 3 is arranged inside the inflatable bed and extends around the periphery thereof. In particular, referring to FIG. 3, the top of the mesh-shaped inclined diaphragm 3 is connected to the side panel 1 through the first reinforcing sheet 31, specifically, the first reinforcing sheet 31 is connected to the inner surface of the side panel 1, and the top edge of the mesh-shaped inclined diaphragm 3 is clamped between the first reinforcing sheet 31 and the inner surface of the side panel 1; the bottom of the mesh-shaped inclined diaphragm 3 is connected to the face layer 2 at the bottom of the side panel 1 through the second reinforcing sheet 32, specifically, the second reinforcing sheet 32 is connected to the inner surface of the face layer 2, and the bottom edge of mesh-shaped inclined diaphragm 3 is claimed between the second reinforcing sheet 32 and the inner surface of the face layer 2, such that the mesh-shaped inclined diaphragm 3 is arranged at the bottom of the inflatable bed. Preferably, the mesh-hole density of the mesh-shaped inclined diaphragm 3 is 10-200 mesh-holes/$dm^2$, and specifically, can be 10 mesh-holes/$dm^2$, 30 mesh-holes/$dm^2$, 50 mesh-holes/$dm^2$, 80 mesh-holes/$dm^2$, 100 mesh-holes/$dm^2$, 120 mesh-holes/$dm^2$, 150 mesh-holes/$dm^2$, 180 mesh-holes/$dm^2$, 200 mesh-holes/$dm^2$, 250 mesh-holes/$dm^2$, 300 mesh-holes/$dm^2$, 350 mesh-holes/$dm^2$, 400 mesh-holes/$dm^2$, 450 mesh-holes/$dm^2$, 500 mesh-holes/$dm^2$, 550 mesh-holes/$dm^2$, 600 mesh-holes/$dm^2$, 650 mesh-holes/$dm^2$, 700 mesh-holes/$dm^2$, 750 mesh-holes/$dm^2$, 800 mesh-holes/$dm^2$, 850 mesh-holes/$dm^2$, 900 mesh-holes/$dm^2$, 950 mesh-holes/$dm^2$, 1000 mesh-holes/$dm^2$ and etc., which all fall in the scope of the present application. Preferably, the first reinforcing sheet 31 and the second reinforcing sheet 32 are made of the same material as the side panel 1 and the face layers 2, by which the inner surfaces of each cloth layer is provided with an adhesive layer, namely, the cloth layer of the first reinforcing sheet 31 and the cloth layer of the second reinforcing sheet 32 each are made of an oxford layer and so on, the adhesive layer is a glue layer or a PVC layer, and at the meantime, the adhesive layer is waterproof. For example, the first reinforcing sheet 31, the second reinforcing sheet 32, the side panel 1 and the face layers 2 can all be made in such a way, that the inner surface of the oxford layer is provided with a PVC layer, which is melted after the first reinforcing sheet 31 and the second reinforcing sheet 32 are heated, such that the PVC flows to the mesh-holes at the edges of the mesh-shaped inclined diaphragm 3, is adhered to the PVC layer of the inner surface of the side panel 1 and the PVC layer of the inner surface of the face layer 2, and is formed after curing.

Furthermore, the connection of the mesh-shaped inclined diaphragm 3 is as follows. The top edge of the mesh-shaped inclined diaphragm 3 is bent towards the face layer 2 at the top of the side panel 1 or at the bottom of the side panel 1, the field between the bent crease line and the top edge of the mesh-shaped inclined diaphragm 3 is the connection of the mesh-shaped inclined diaphragm 3, and the connection is parallel to the side panel 1. Similarly, the bottom edge of the mesh-shaped inclined diaphragm 3 is bent towards the center of the face layer 2 at the bottom of the side panel 1, or towards the periphery of the face layer 2 at the bottom of the side panel 1, the field between the bent crease line and the bottom edge of the mesh-shaped inclined diaphragm 3 is the connection of the bottom edge of the mesh-shaped inclined diaphragm 3, and the connection is parallel to the face layer 2.

Figure 3:
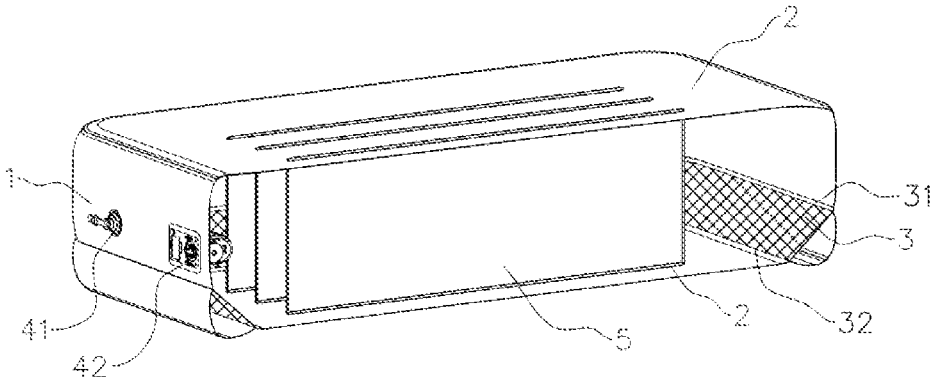
FIG. 3 schematically shows a cross-sectional view of the sheet-shaped vertical drawing strap extending along the length direction of the inflatable bed according to Example 1 of the present application.

The vertical drawing strap 5 can be a sheet-shaped vertical drawing strap 5 extending along the width direction of the inflatable bed as shown in FIG. 2, or a sheet-shaped vertical drawing strap 5 extending along the length direction of the inflatable bed as shown in FIG. 3, both of which can form a plurality of concave linear connecting strips on the face layer 2 of the inflatable bed, specifically, after the inflatable bed is filled with air, the side panel 1 and the face layers 2 expand outwards, while the two face layers 2 are pulled inwards by the sheet-shaped vertical drawing straps 5, such that the relatively concave linear connecting strips are formed on the face layers 2.

Figure 4:
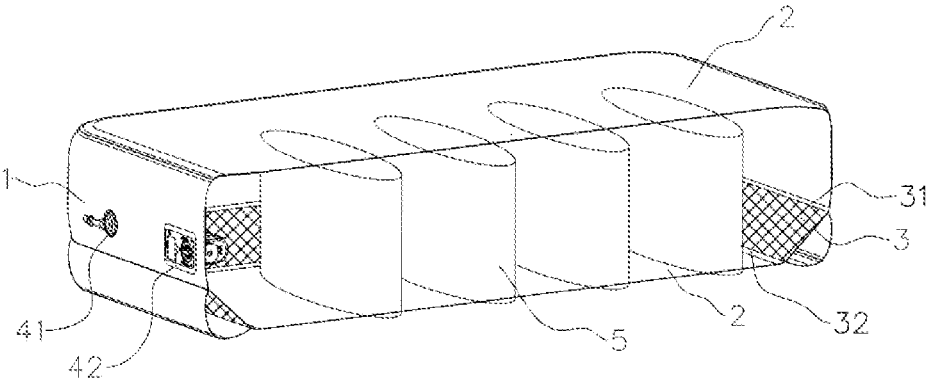
FIG. 4 schematically shows a cross-sectional view of the lateral-connected strap-shaped vertical drawing strap extending along the width direction of the inflatable bed according to Example 1 of the present application.
Figure 5:
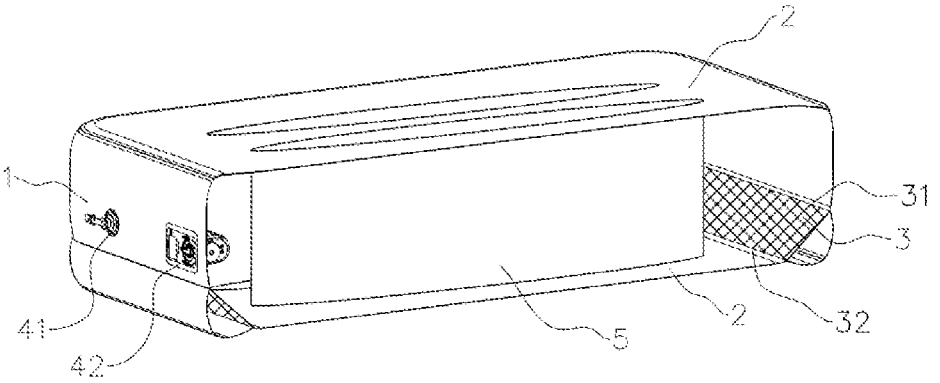
FIG. 5 schematically shows a cross-sectional view of the lateral-connected strap-shaped vertical drawing strap extending along the length direction of the inflatable bed according to Example 1 of the present application.

Referring to FIGS. 4 and 5, the vertical drawing strap 5 can also be formed in such a way, that two ends of the strap-shaped sheet are connected end to end, to form an elliptical shape, the elliptical lateral side of the elliptical vertical drawing strap is parallel to the horizontal plane, and the long axis of the elliptical lateral side of the strap-shaped sheet can extend along the length direction or the width direction of the inflatable bed, to form a lateral-connected strap-shaped vertical drawing strap 5. A plurality of concave elliptical connecting strips are formed on the face layers 2 of the inflatable bed, in particular, after the inflatable bed is filled with air, the side panel 1 and the face layers 2 relatively expand outwards, while the elliptical mesh-shaped vertical drawing straps 5 pull the face layers 2 towards the inside of the inflatable bed, such that the hollow elliptical connecting strip is concave inwards relative to the expanded face layers 2.

Figure 6:
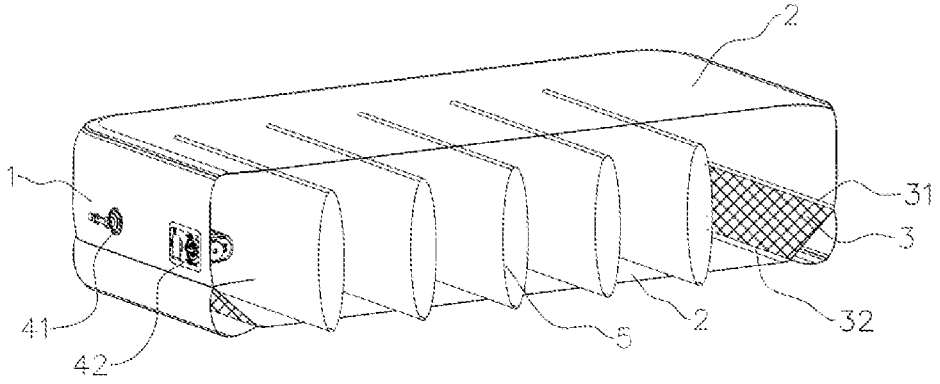
FIG. 6 schematically shows a cross-sectional view of the breadth-connected strap-shaped vertical drawing strap extending along the width direction of the inflatable bed according to Example 1 of the present application.
Figure 7:
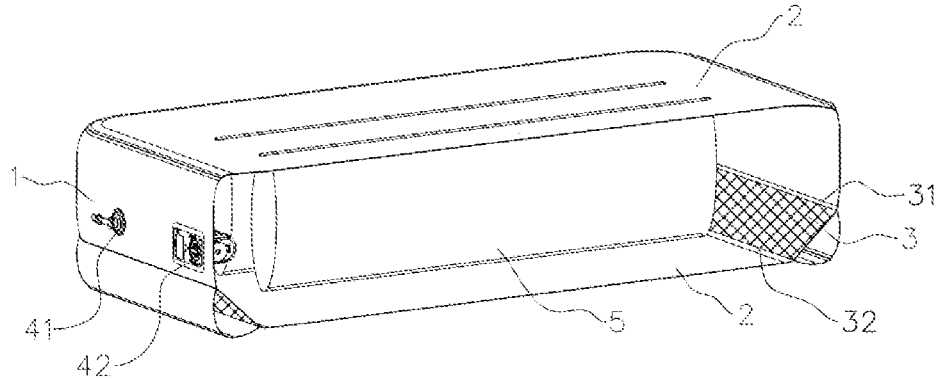
FIG. 7 schematically shows a cross-sectional view of the breadth-connected strap-shaped vertical drawing strap extending along the length direction of the inflatable bed according to Example 1 of the present application.

Referring to FIGS. 6-7, the vertical drawing strap 5 can also be formed in such a way, that two ends of the strap-shaped drawing strap are connected end to end, to form an elliptical shape, wherein the elliptical lateral side of the elliptical vertical drawing strap is perpendicular to the horizontal plane, and the end of the strap-shaped drawing strap in the breadth direction can extend along the length direction or the width direction of the inflatable bed, to form a breadth-connected strap-shaped vertical drawing strap 5. The vertical drawing strap 5 in the present application includes but is not limited to the above sheet-shaped vertical strap 5, the lateral-connected strap-shaped vertical drawing strap 5 connected end to end, and the breadth-connected strap-shaped vertical drawing strap 5 connected end to end.

The implement principle of Example 1 is as follows: the mesh is formed by weaving elastic or inelastic fibers, then a mesh-shaped inclined diaphragm 3 is obtained by cutting according to the required breadth. The top edge of the mesh-shaped inclined diaphragm 3 is covered on and connected to the inner surface of the side panel 1 by means of the first reinforcing sheet 31, such that the top edge of the mesh-shaped inclined diaphragm 3 is fixed between the first reinforcing sheet 31 and the inner surface of the side panel 1. Similarly, the bottom edge of the mesh-shaped inclined diaphragm 3 is fixed between the second reinforcing sheet 32 and the inner surface of the face layer 2 at the bottom of the side panel 1, such that the mesh-shaped inclined diaphragm 3 is connected to the side panel 1 and the face layers 2. Then one end of each of the plurality of vertical drawing straps 5 is melted and connected to the inner surface of one face layer 2 while the other end thereof is melted and connected to the inner surface of the other face layer 2. Finally, the top edge of the side panel 1 is melted and connected to the periphery of one face layer 2, and the bottom edge of the side panel 1 is melted and connected to the periphery of the other face layer 2, thereby obtaining the inflatable bed with mesh-shaped inclined diaphragm 3 at the bottom thereof.

Example 2

Figure 8:
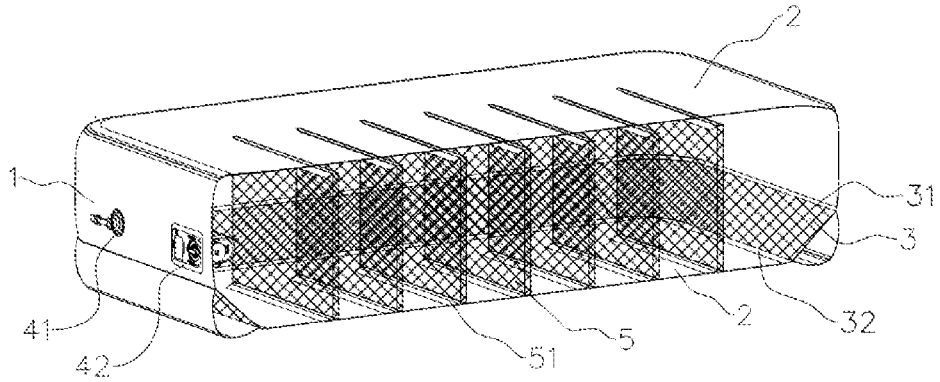
FIG. 8 schematically shows a cross-sectional view of the inflatable bed with mesh-shaped vertical drawing straps according to Example 2 of the present application.

FIG. 8 shows Example 2, which is different from Example 1 in that the plurality of vertical drawing straps 5 are all mesh-shaped vertical drawing straps 5, the end of the mesh-shaped vertical drawing strap 5 is connected to the inner surface of the face layer 2 by a third reinforcing sheet 51. Specifically, the third reinforcing sheet 51 is connected to the inner surface of the face layer 2, and the connection of the mesh-shaped vertical drawing strap 5 is clamped between the third reinforcing sheet 51 and the inner surface of the face layer 2.

Figure 9:
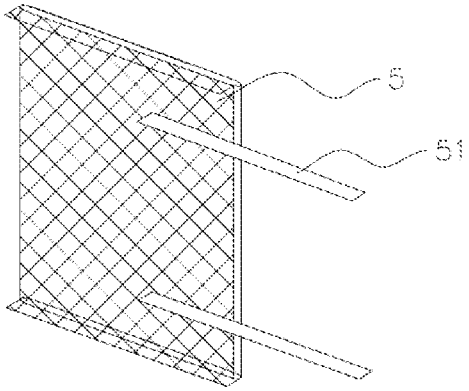
FIG. 9 is schematic view of the sheet-shaped mesh according to Example 1 of the present application, whose top and bottom are bent towards the same direction.
Figure 10:
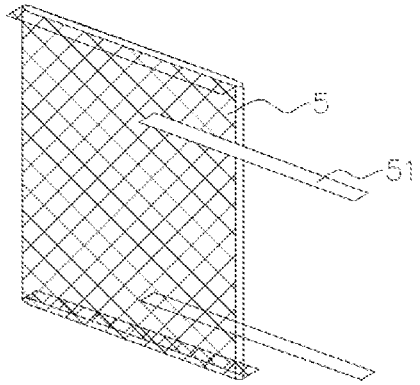
FIG. 10 is a schematic view of the sheet-shaped mesh according to Example 1 of the present application, whose top and bottom are bent towards opposite directions.

Furthermore, the connection of the mesh-shaped vertical drawing strap 5 to the face layer 2 is:

(1) When the mesh-shaped vertical drawing strap 5 is a sheet-shaped mesh, the top and the bottom of the mesh-shaped drawing strap 5 are both connected to the face layers 2, and the top and the bottom of the mesh-shaped vertical drawing strap 5 are both bent in the direction towards the same side (as shown in FIG. 9), or the top and the bottom of the mesh-shaped vertical drawing strap 5 are bent towards opposite directions (as shown in FIG. 10), and the field between the bent crease line and the top edge or the bottom edge of the mesh-shaped vertical drawing strap 5 is the connection between the mesh-shaped vertical drawing strap 5 and the third reinforcing sheet 51.

Figure 11:
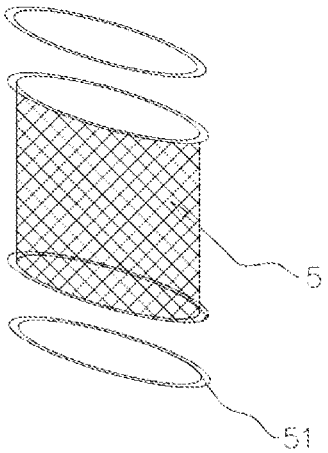
FIG. 11 is a schematic view of the lateral-connected strap-shaped mesh according to Example 1 of the present application, whose top and bottom are bent towards the same direction.
Figure 12:
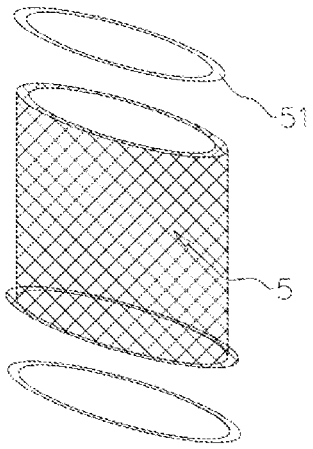
FIG. 12 is a schematic view of the lateral-connected strap-shaped mesh according to Example 1 of the present application, whose top and bottom are bent towards opposite directions.

(2) When the mesh-shaped vertical drawing strap 5 is the elliptical mesh-shaped vertical drawing strap 5 formed by connecting the two ends of the strap-shaped mesh end to end, and the elliptical lateral side of the elliptical mesh-shaped vertical drawing strap 5 is parallel to the horizontal plane, the elliptical lateral sides at the top and the bottom of the mesh-shaped vertical drawing strap 5 are both bent in the direction towards the same side (as shown in FIG. 11), or the elliptical lateral sides at the top and the bottom of the mesh-shaped vertical drawing strap 5 are bent towards opposite directions (as shown in FIG. 12), the field between the bent crease line and the top edge or the bottom edge of the mesh-shaped vertical drawing strap 5 is the connection between the mesh-shaped vertical drawing strap 5 and the third reinforcing sheet 51.

Figure 13:
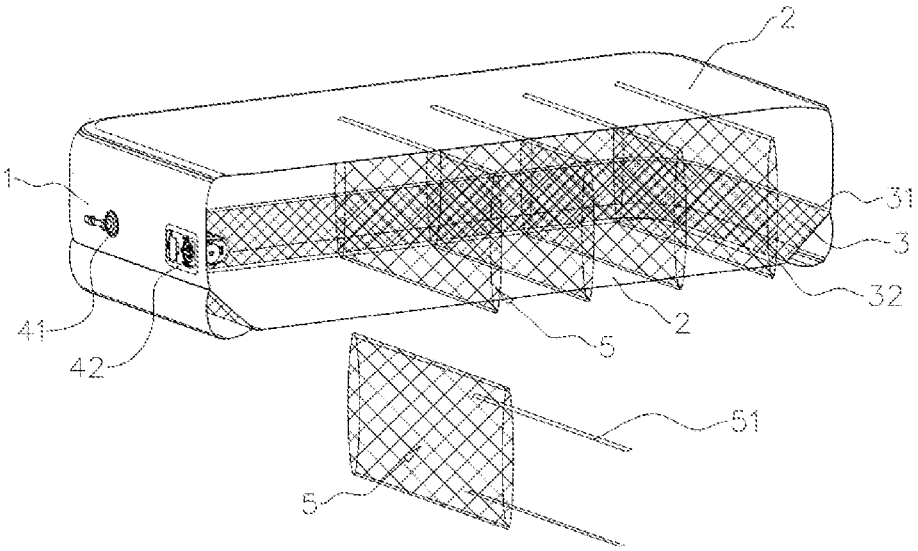
FIG. 13 schematically shows an exploded sectional view of the breadth-connected strap-shaped mesh extending along the width direction of the inflatable bed according to Example 1 of the present application.
Figure 14:
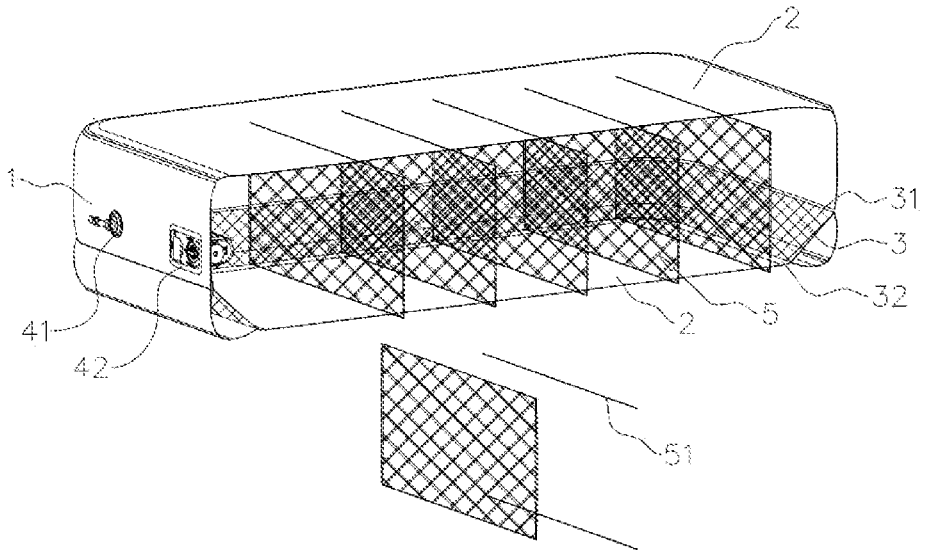
FIG. 14 schematically shows an exploded sectional view showing another connection way between the breadth-connected strap-shaped mesh according to Example 1 of the present application and the face layer.
Figure 15:
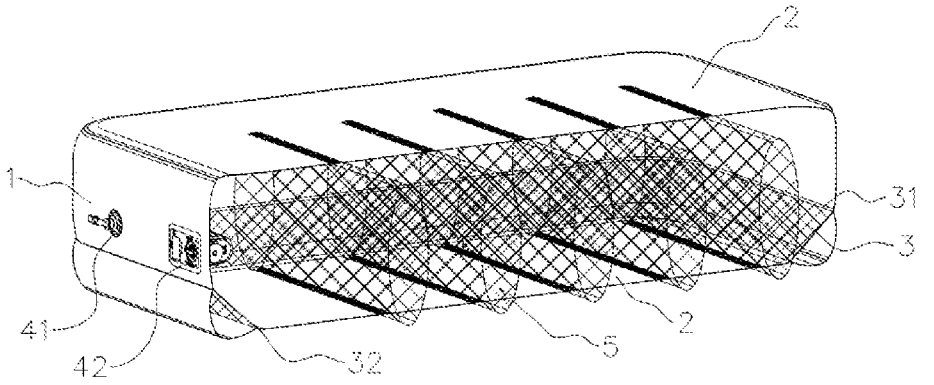
FIG. 15 is a schematic exploded sectional view showing another connection way between the breadth-connected strap-shaped mesh and the face layer according to Example 1 of the present application.

(3) when the mesh-shaped vertical drawing strap 5 is the elliptical mesh-shaped vertical drawing strap 5 formed by connecting the two ends of the strap-shaped mesh end to end, and the elliptical lateral side of the elliptical mesh-shaped vertical drawing strap 5 is perpendicular to the horizontal plane, the field of the elliptical mesh-shaped vertical drawing strap 5 in the breadth direction connected to the inner surface of the face layer 2 is the connection between the mesh-shaped vertical drawing strap 5 and the third reinforcing sheet 51, which represents the form of linear connecting strip, or hollow rectangular connecting frame or solid rectangular connecting zone (as shown in FIGS. 13-15); and the length of the third reinforcing sheet 51 is preferably larger than or equal to the breadth of the elliptical mesh-shaped vertical drawing strap 5.

In the case that the connection represents a linear connecting strip in above (3), as shown in FIG. 13, the connection between the end of the mesh-shaped vertical drawing strap 5 and the face layer 2 represents a form of linear connecting strip, which means that the breadth of the mesh-shaped vertical drawing strap 5 is unchanged, and the connecting area between the end of the mesh-shaped vertical drawing strap 5 and the face layer 2 is relatively small. After the inflatable bed is filled with air, the mesh-shaped vertical drawing strap 5 is pulled by the top face layer 2 and the bottom face layer 2, specifically, the drawing straps at two sides of the long axis of the elliptical mesh-shaped vertical drawing strap 5 are drawn in the direction close to the long axis, until the drawing straps at two sides of the long axis are attached to each other, such that the elliptical mesh-shaped vertical drawing strap 5 is pulled to be linear.

In the case that the connection represents a hollow rectangular connecting frame in above (3), as shown in FIG. 14, the connection between the end of the mesh-shaped vertical drawing strap 5 and the face layer 2 represents a form of hollow rectangular connecting frame, which means that the breadth of the mesh-shaped vertical drawing strap 5 is unchanged, a certain length of the strap-shaped vertical drawing strap 5 is connected to the face layer 2, while the intermediate portion of the certain length of the strap-shaped drawing strap 5 is not connected to the face layer 2, and only the beginning point and the ending point of the certain length in the breadth direction are connected to the face layer 2 to form a long side of the rectangular connecting frame, while the side edge of the strap-shaped vertical drawing strap 5 in the range of the certain length is connected to the face layer 2 to form a short side of the rectangular connecting frame. After the inflatable bed is filled with air, the mesh-shaped vertical drawing strap 5 is pulled by the top face layer 2 and the bottom face layer 2, specifically, the drawing straps at two sides of the long axis of the elliptical mesh-shaped vertical drawing strap are drawn in the direction close to the long axis, such that the elliptical mesh-shaped vertical drawing strap 5 is pulled to have a rectangular longitudinal section.

In the case that the connection represents a solid rectangular connection zone in above (3), as shown in FIG. 15, the connection between the end of the mesh-shaped vertical drawing strap 5 and the face layer 2 represents a form of solid rectangular connecting zone, which means that the breadth of the mesh-shaped vertical drawing strap 5 is unchanged, a certain length of the strap-shaped vertical drawing strap 5 is connected to the face layer 2, and the strap-shaped vertical drawing strap 5 is connected to the face layer 2 over the whole certain length, that is, the area of the connection between the mesh-shaped vertical drawing strap 5 and the face layer 2 is larger than the above-mentioned linear connecting strip. After the inflatable bed is filled with air, the mesh-shaped vertical drawing strap 5 is pulled by the top face layer 2 and the bottom face layer 2, specifically, the drawing straps at two sides of the long axis of the elliptical mesh-shaped vertical drawing strap 5 are drawn in the direction close to the long axis, such that the elliptical mesh-shaped vertical drawing strap 5 is pulled to have a rectangular longitudinal section.

Preferably, the mesh-hole density of the mesh-shaped vertical drawing strap 5 is 10-200 mesh-holes/$dm^2$, and specifically, can be 10 mesh-holes/$dm^2$, 30 mesh-holes/$dm^2$, 50 mesh-holes/$dm^2$, 80 mesh-holes/$dm^2$, 100 mesh-holes/$dm^2$, 120 mesh-holes/$dm^2$, 150 mesh-holes/$dm^2$, 180 mesh-holes/$dm^2$, 200 mesh-holes/$dm^2$, 250 mesh-holes/$dm^2$, 300 mesh-holes/$dm^2$, 350 mesh-holes/$dm^2$, 400 mesh-holes/$dm^2$, 450 mesh-holes/$dm^2$, 500 mesh-holes/$dm^2$, 550 mesh-holes/$dm^2$, 600 mesh-holes/$dm^2$, 650 mesh-holes/$dm^2$, 700 mesh-holes/$dm^2$, 750 mesh-holes/$dm^2$, 800 mesh-holes/$dm^2$, 850 mesh-holes/$dm^2$, 900 mesh-holes/$dm^2$, 950 mesh-holes/$dm^2$, 1000 mesh-holes/$dm^2$ and etc., which all fall in the scope of the present application.

The mesh-shaped inclined diaphragm 3 is illustrated by taking a sheet-shaped mesh as an example for the mesh-shaped vertical drawing strap 5 of the present example, however the inflatable bed with mesh-shaped inclined diaphragm 3 at the bottom in the present example is provided with such mesh-shaped vertical drawing strap, that includes but is not limited to mesh-shaped vertical drawing straps 5 extending along the width direction of the inflatable bed, mesh-shaped vertical drawing straps 5 extending along the length direction of the inflatable bed, lateral-connected strap-shaped vertical drawing straps 5 extending along the width direction of the inflatable bed, lateral-connected strap-shaped vertical drawing straps 5 extending along the length direction of the inflatable bed, breadth-connected strap-shaped vertical drawing straps 5 extending along the breadth direction of the inflatable bed, breadth-connected strap-shaped vertical drawing straps 5 extending along the length direction of the inflatable bed.

The implement principle of example 2 differs from that of example 1 in that when the mesh-shaped inclined diaphragm 3 is connected to the side panel 1 and the face layers 2, the connection of one side of the mesh-shaped vertical drawing strap 5 is covered on and connected to the inner surface of one face layer 2 by means of the third reinforcing sheet 51, the connection of the one side of the mesh-shaped vertical drawing strap 5 is fixed between the third reinforcing sheet 51 and the inner surface of the face layer 2. Similarly, the connection of the other side of the mesh-shaped vertical drawing strap 5 is fixed between another third reinforcing sheet 51 and the inner surface of the other face layer 2, and the connection between the mesh-shaped vertical drawing strap 5 and two face layers 2 is achieved.

Example 3

Figure 16:
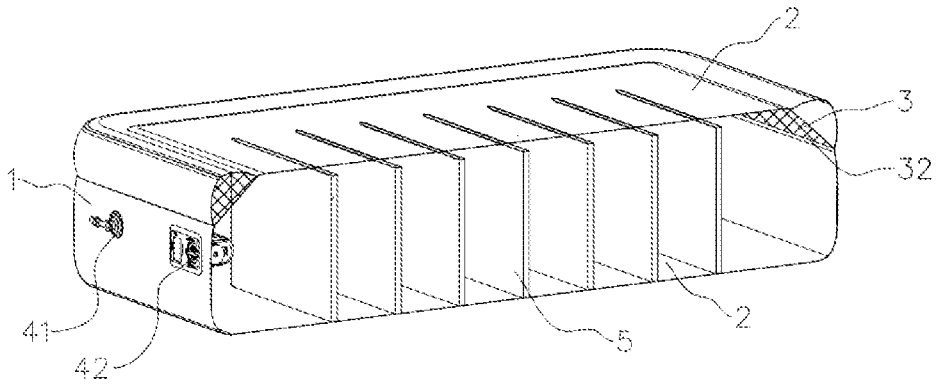
FIG. 16 is a schematic sectional view of the inflatable bed according to Example 3 of the present application.

Referring to FIG. 16, the present example is different from Example 1 in that the top of the mesh-shaped inclined diaphragm 3 is connected to the face layer 2 at the top of side panel 1 by a second reinforcing sheet 32, specifically, the second reinforcing sheet 32 is connected to the inner surface of the face layer 2, and the top edge of the mesh-shaped inclined diaphragm 3 is clamped between the second reinforcing sheet 32 and the inner surface of the face layer 2; the bottom of the mesh-shaped inclined diaphragm 3 is connected to the side panel 1 by the first reinforcing sheet 31, specifically, the first reinforcing sheet 31 is connected to the inner surface of the side panel 1, and the bottom edge of the mesh-shaped inclined diaphragm 3 is clamped between the first reinforcing sheet 31 and the inner surface of the side panel 1, such that the mesh-shaped inclined diaphragm 3 is arranged at the top of the inflatable bed.

The implement principle of example 3 is different from that of example 1 in that the top edge of the mesh-shaped inclined diaphragm 3 is covered on and connected to the inner surface of the face layer 2 by means of the second reinforcing sheet 32, such that the top edge of the mesh-shaped inclined diaphragm 3 is fixed between the second reinforcing sheet 32 and the inner surface of the face layer 2 at the top of the side panel 1. Similarly, the bottom edge of the mesh-shaped inclined diaphragm 3 is fixed between the first reinforcing sheet 31 and the inner surface of the side panel 1. The connection between the mesh-shaped inclined diaphragm 3 and the side panel 1 and the face layer 2 are completed, thereby obtaining the inflatable bed with mesh-shaped inclined diaphragm 3 at the top thereof.

Example 4

Figure 17:
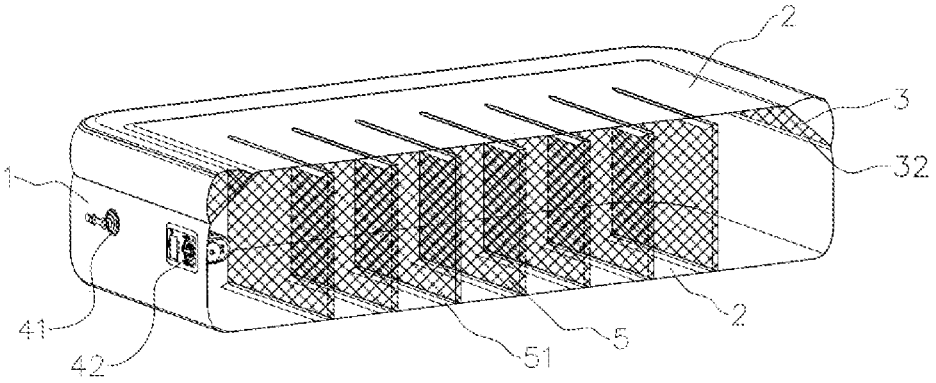
FIG. 17 is a schematic sectional view of the inflatable bed according to Example 4 of the present application.

Referring to FIG. 17, the present example is different from example 2 in that the top of the mesh-shaped inclined diaphragm 3 is connected to the face layer 2 at the top of side panel 1 by the second reinforcing sheet 32, specifically, the second reinforcing sheet 32 is connected to the inner surface of the face layer 2, and the top edge of the mesh-shaped inclined diaphragm 3 is clamped between the second reinforcing sheet 32 and the inner surface of the face layer 2; the bottom of the mesh-shaped inclined diaphragm 3 is connected to the side panel 1 by the first reinforcing sheet 31, specifically, the first reinforcing sheet 31 is connected to the inner surface of the side panel 1, and the bottom edge of the mesh-shaped inclined diaphragm 3 is clamped between the first reinforcing sheet 31 and the inner surface of the side panel 1, such that the mesh-shaped inclined diaphragm 3 is arranged at the top of the inflatable bed.

The implement principle of example 4 is different from that of example 3 in that the connection of one side of the mesh-shaped vertical drawing strap 5 is covered on and connected to the inner surface of one face layer 2 through the third reinforcing sheet 51 while connecting the mesh-shaped inclined diaphragm 3 to the side panel 1 and the face layer 2, such that the connection of the one side of the mesh-shaped vertical drawing strap 5 is fixed between the third reinforcing sheet 51 and the inner surface of the face layer 2; similarly, the connection of the other side of the mesh-shaped vertical drawing strap 5 is fixed between the other third reinforcing sheet 51 and the inner surface of the other face layer 2, thereby completing the connection between the mesh-shaped vertical drawing strap 5 and two face layers 2.

Example 5

Figure 18:
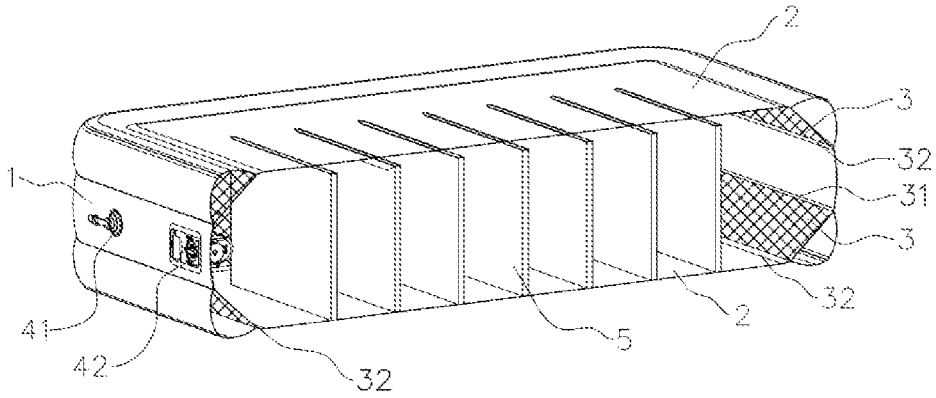
FIG. 18 is a schematic sectional view of the inflatable bed according to Example 5 of the present application.

Referring to FIG. 18, the present example is different from example 1 in that the quantity of the mesh-shaped inclined diaphragm 3 is two, the top of the other mesh-shaped inclined diaphragm 3 is connected to the face layer 2 at the top of the side panel 1 through the second reinforcing sheet 32, specifically, the second reinforcing sheet 32 is connected to the inner surface of the face layer 2, such that the top edge of the mesh-shaped inclined diaphragm 3 is clamped between the second reinforcing sheet 32 and the inner surface of the face layer 2; the bottom of the mesh-shaped inclined diaphragm 3 is connected to the side panel 1 by the first reinforcing sheet 31, specifically, the first reinforcing sheet 31 is connected to the inner surface of the side panel 1, and the bottom edge of the mesh-shaped inclined diaphragm 3 is clamped between the first reinforcing sheet 31 and the inner surface of the side panel 1, so the top and the bottom of the inflatable bed are both provided with a mesh-shaped inclined diaphragm 3.

The implement principle of example 5 is different from example 1 in that the top edge of the other mesh-shaped inclined diaphragm 3 is covered on and connected to the inner surface of the face layer 2 by the second reinforcing sheet 32 while connecting one mesh-shaped inclined diaphragm 3 to the side panel 1 and the face layer 2 at the top of the side panel 1, such that the top edge of the mesh-shaped inclined diaphragm 3 is fixed between the second reinforcing sheet 32 and the inner surface of the face layer 2 at the top of the side panel 1; similarly, the bottom edge of the mesh-shaped inclined diaphragm 3 is fixed between the first reinforcing sheet 31 and the inner surface of the side panel 1, thereby completing the connection of the mesh-shaped inclined diaphragm 3 to the side panel 1 and the face layer 2, and obtaining the inflatable bed with mesh-shaped inclined diaphragm 3 with mesh-shaped inclined diaphragms 3 both at the top and at the bottom thereof.

Example 6

Figure 19:
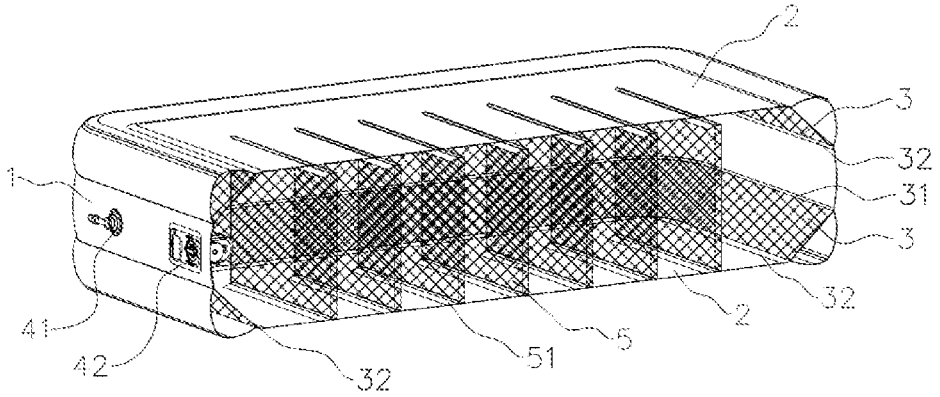
FIG. 19 is a schematic sectional view of the inflatable bed according to Example 6 of the present application.

FIG. 19 shows example 6, which is different from example 2 in that the quantity of the mesh-shaped inclined diaphragm 3 is two, the top of the other mesh-shaped inclined diaphragm 3 is connected to the face layer 2 at the top of the side panel 1 through the second reinforcing sheet 32, specifically, the second reinforcing sheet 32 is connected to the inner surface of the face layer 2, and the top edge of the mesh-shaped inclined diaphragm 3 is clamped between the second reinforcing sheet 32 and the inner surface of the face layer 2; the bottom of the mesh-shaped inclined diaphragm 3 is connected to the side panel 1 by the first reinforcing sheet 31, specifically, the first reinforcing sheet 31 is connected to the inner surface of the side panel 1, and the bottom edge of the mesh-shaped inclined diaphragm 3 is clamped between the first reinforcing sheet 31 and the inner surface of the side panel 1, so the top and the bottom of the inflatable bed are both provided with mesh-shaped inclined diaphragms 3.

The implement principle of example 6 is different from that of example 5 in that the connection of one side of the mesh-shaped vertical drawing strap 5 is covered on and connected to the inner surface of one face layer 2 by the third reinforcing sheet 51 while connecting the mesh-shaped inclined diaphragm 3 to the side panel 1 and the face layer 2, such that the connection of the one side of the mesh-shaped vertical drawing strap 5 is fixed between the third reinforcing sheet 51 and the inner surface of the face layer 2; similarly, the connection of the other side of the mesh-shaped vertical drawing strap 5 is fixed between the other third reinforcing sheet 51 and the inner surface of the other face layer 2, thereby completing the connection of the mesh-shaped vertical drawing strap 5 to the two face layers 2.

Example 7

This example differs from Example 6 in that the above mesh-shaped vertical drawing strap 5 and mesh-shaped inclined diaphragm 3 were both made by cutting the mesh woven by modified polyester fiber, the modified polyester fiber was prepared by melting and spinning the modified polyester fiber masterbatch, and furthermore, the modified polyester fiber masterbatch was prepared by the following steps:

0.3 kg of nano silica, 0.3 kg of nano zinc oxide were mixed uniformly, and were treated by microwave for 15 minutes at a power of 300 W; then 0.2 kg of cation dispersant (0.15 kg of Brominated 1-methyl-3-octyl-imidazolium salt, 0.05 kg of Dodecylpyridine hydrochloride) was added under stirring homogeneously, and then a treatment by microwave at a power of 300 W is continued for 8 minutes, so a dispersed material was prepared;

5.5 kg of polyester masterbatch, 1.0 kg of polyamide-6, 0.5 kg of ethylene-methyl acrylate copolymer were mixed, and heated to 150° C. under stirring, above dispersed material was added under stirring, and extruding and granulating were performed to obtain a modified polyester fiber masterbatch. In particular, the temperature of the extruding zone during extruding and granulating were as follows: the first zone was 155° C., the second zone was 170° C., the third zone was 185° C., the fourth zone was 200° C., and the fifth zone was 190° C.

In particular, the particle size of the nano silica was 20-30 nm, the BET specific surface area of the nano silica was 100-120 $m^2/g$; the size of the nano zinc oxide was 30-40 nm, the BET surface area of the nano zinc oxide was 50-80 $m^2/g$.

The modified polyester fiber was prepared by spinning of the modified polyester fiber masterbatch, and the spinning parameters were as follows:

The spinning temperature was 295° C., the spinning speed was 2000 m/min, the drawing speed was 650 m/min, the spin-stretch ratio was 3, the side-blowing temperature was 22° C., the relative humidity of the supply air was 55%, the air speed was 0.3 m/s, and the stretching temperature was 65° C.

In the present example, the source of the polyester masterbatch, the polyamide-6, the ethylene-methyl acrylate copolymer are shown in table 1:

TABLE 1 source of the raw materials

| Name of the material | Manufacturer | Model/brand |
|---|---|---|
| Polyester master batch | Shanghai Huzheng Industrial Co., Ltd | PK20-PET |
| Polyamide-6 | Dutch DSM | K224-PG8 |
| Ethylene-methyl acrylate copolymer | American DuPont | 1209 AC |

The raw materials in the above table were all specifically selected for the examples and comparative examples. However, in the actual production of the modified polyester fiber, the sources of the raw materials are not limited to the above models.

Examples 8-9

These examples differed from example 7 in that: the usage amount of the raw materials and the process parameters were different, specifically shown in table 2:

TABLE 2 raw materials, the usage amount and the process parameters of the modified polyester fiber masterbatch in Examples 7-9.

| Items | Example 7 | Example 8 | Example 9 |
|---|---|---|---|
| Nano silica (kg) | 0.3 | 0.5 | 0.6 |
| Nano zinc oxide (kg) | 0.3 | 0.2 | 0.1 |
| Power of the first treatment by microwave/W | 300 | 350 | 400 |
| Time of the first treatment by microwave/min | 15 | 12 | 10 |
| Cation Dispersant | 0.15 kg of Brominated 1-methyl-3-octylimidazolium salt, 0.05 kg of Dodecylpyridine hydrochloride | 0.18 kg of Brominated 1-methyl-3-octylimidazolium salt, 0.07 kg of Dodecylpyridine hydrochloride | 0.2 kg of Brominated 1-methyl-3-octylimidazolium salt, 0.1 kg of Dodecylpyridine hydrochloride |
| Power of the first treatment by microwave/W | 300 | 350 | 400 |
| Time of the first treatment by microwave/min | 8 | 5 | 3 |
| Polyester masterbatch (kg) | 5.5 | 6.2 | 7.0 |

TABLE 2-continued raw materials, the usage amount and the process parameters of the modified polyester fiber masterbatch in Examples 7-9.

| Items | | Example 7 | Example 8 | Example 9 |
|---|---|---|---|---|
| Polyamide-6 (kg) | | 1.0 | 1.2 | 0.8 |
| Ethylene-methyl acrylate copolymer (kg) | | 0.5 | 0.8 | 0.6 |
| Heating temperature under stirring/° C. | | 150 | 150 | 155 |
| Temperature of extrusion granulation | first zone/° C. | 155 | 160 | 165 |
| | second zone/° C. | 170 | 175 | 180 |
| | third zone/° C. | 185 | 190 | 195 |
| | fourth zone/° C. | 200 | 205 | 210 |
| | fifth zone/° C. | 190 | 195 | 200 |

Example 10

This example differed from above example 7 in that the preparation steps of the modified polyester fiber masterbatch are different, the specific steps are as follow:

0.3 kg of nano silica, 0.3 kg of nano zinc oxide and 0.2 kg of cation dispersant (0.15 kg of Brominated 1-methyl-3-octylimidazolium salt, 0.05 kg of Dodecylpyridine hydrochloride) were mixed uniformly to obtain a mixture; and 5.5 kg of polyester masterbatch, 1.0 kg of polyamide-6, 0.5 kg of ethylene-methyl acrylate copolymer were mixed, and heated to 150° C. under stirring, above mixture was added under stirring, and extruding and granulating were performed to obtain a modified polyester fiber masterbatch. In particular, the temperature of the extruding zone during extruding and granulating were as follows: the first zone: 155° C., the second zone: 170° C., the third zone: 185° C., the fourth zone: 200° C., and the fifth zone: 190° C.

Comparative Example 1

The comparative example 1 differed from the above example 7 in that the polyamide-6 is replaced with the same usage amount of polyamide-66.

Comparative Example 2

This Comparative example 2 differed from above example 7 in that the usage amount of polyamide-6 was 0.3 kg, and the usage amount of polyester masterbatch was 6.2 kg.

Comparative Example 3

This Comparative example 3 differed from above example 7 in that the usage amount of polyamide-6 was 2.5 kg, and the usage amount of polyester masterbatch was 4 kg.

Comparative Example 4

This comparative example 4 differed from above example 7 in that Nano silica is replaced with the same usage amount of Nano-$TiO_2$.

Comparative Example 5

This comparative example 5 differed from above example 7 in that the Cation Dispersant includes 0.15 kg of Brominated 1-methyl-3-octylimidazolium salt, 0.05 kg of Brominated 1-methyl-3-octylpyridinium salt.

The raw materials and usage amount thereof in above Comparative examples 1-5 were shown in table 4:

TABLE 4 raw materials and usage amount in Example 7 and Comparative examples 1-5

| Items | Example 7 | Comparative example 1 | Comparative example 2 | Comparative example 3 | Comparative example 4 | Comparative example 5 |
|---|---|---|---|---|---|---|
| Nano silica ( kg ) | 0.3 | 0.3 | 0.3 | 0.3 | / | 0.3 |
| Nano zinc oxide ( kg ) | 0.3 | 0.3 | 0.3 | 0.3 | 0.3 | 0.3 |
| Nano titanium dioxide ( kg ) | / | / | / | / | 0.3 | / |
| Cation Dispersant | 0.15 kg of Brominated 1-methyl-3-octylimidazolium salt, 0.05 kg of Dodecylpyridine hydrochloride | | | | | 0.15 kg of Brominated 1-methyl-3-octylimidazolium salt, 0.05 kg of Brominated 1-methyl-3-octylpyridinium salt |
| Polyester masterbatch (kg) | 5.5 | 5.5 | 6.2 | 4 | 5.5 | 5.5 |
| Polyamide-6 (kg) | 1.0 | / | 0.3 | 2.5 | 1.0 | 1.0 |

TABLE 4-continued raw materials and usage amount in Example 7 and Comparative examples 1-5

| Items | Example 7 | Comparative example 1 | Comparative example 2 | Comparative example 3 | Comparative example 4 | Comparative example 5 |
|---|---|---|---|---|---|---|
| polyamide-66 (kg) | / | 1.0 | / | / | / | / |
| Ethylene-methyl acrylate copolymer (kg) | 0.5 | 0.5 | 0.5 | 0.5 | 0.5 | 0.5 |

The modified polyester fiber prepared in above Examples 7-10 and Comparative examples 1-5 were tested for the tensile strength, the elongation at fracture, the bending property. The mesh was further woven by the modified polyester fiber of corresponding examples and comparative examples (all were woven to be a mesh with a mesh-hole density of 200 mesh-holes/$dm^2$), and the tensile strength of the corresponding mesh was tested. The test method and the test data were shown as follows:

I. Test method (1) Tests of the tensile strength and elongation at fracture were tested according to GB/T14344-2008 testing method for tensile of man-made filament yarns. In particular, the gripper was moved at a speed of 250 mm/min;

(2) Bending test: a modified polyester fiber was folded in half and compacted under a pressure of 3 atmospheres for 1 hour, to observe whether there was a crease at the folded portion of the modified polyester fiber;

(3) Tests of the tensile strength of mesh: a mesh sample with a length of 50 cm and a width of 5 cm was cut, and tested for the tensile strength at a tensile speed of 50 mm/min.

II. Test results

TABLE 5 performance of the modified polyester fiber and the mesh in Examples 7-10 and Comparative examples 1-5

| Items | Tensile strength of the fiber/ (N/mm) | Elongation at fracture of the fiber/% | Bending situation of the fiber | Tensile strength of the fiber after bending/ (N/mm)/ (N/mm) | Tensile strength of the mesh/ (N/mm) |
|---|---|---|---|---|---|
| Example 7 | 6.9 | 45.32 | No crease at the folded portion | 6.6 | 28.23 |
| Example 8 | 7.2 | 45.93 | No crease at the folded portion | 6.9 | 28.95 |
| Example 9 | 7.3 | 46.04 | No crease at the folded portion | 7.1 | 29.25 |
| Example 10 | 5.8 | 42.93 | No crease at the folded portion | 5 | 25.58 |
| Comparative example 1 | 6.4 | 44.98 | There was a crease at the folded portion, and an included angle was defined. | 5.5 | 25.96 |
| Comparative example 2 | 7.1 | 45.89 | No crease at the folded portion | 6.4 | 28.84 |
| Comparative example 3 | 6.3 | 44.68 | There was a crease at the folded portion, and an included angle was defined. | 5.6 | 26.83 |
| Comparative example 4 | 6.5 | 44.77 | No crease at the folded portion | 5.9 | 27.31 |
| Comparative example 5 | 6.4 | 45.07 | There was a crease at the folded portion, and an included angle was defined. | 5.9 | 27.75 |

According to above data, the modified polyester fiber prepared in the present application has a good flexibility and a good bending resistance, and is not easy to deform and can maintain a good tensile strength after bending. The mesh woven by the modified polyester fiber can be applied to be a mesh-shaped vertical drawing strap 5 and a mesh-shaped inclined diaphragm 3, such that a good connection and a good drawing stability of the inflatable bed can still be maintained after being deflated and folded for many times.

Polyamide-6 is replaced with the same usage amount of Polyamide-66 in the comparative example 1, the tensile strength and the elongation at fracture of the modified polyester fiber prepared are both reduced, there is obvious crease at the folded portion after bending, and the tensile strength after bending is reduced. It can be seen that polyamide-6 is added into polyester masterbatch in the present application for modification, which can improve the tensile strength and flexibility of the modified polyester fiber, such that the modified polyester fiber has excellent flexibility, resistant bending and crease resistance.

The usage amount of the polyamide-6 in Comparative example 2 was relatively low, the tensile strength and the elongation at fracture of the modified polyester fiber were increased a little, however, there was an obvious crease at the folded portion of the fiber, and the tensile strength of the modified polyester fiber after bending was decreased significantly. The usage amount of the polyamide-6 in Comparative example 3 was excessive, the tensile strength and the elongation at facture of the prepared modified polyester fiber were decreased compared with that of Example 7, probably because the polyamide-6 itself has a flexibility and an elasticity, which reduces the tensile strength of the polyester fiber when the usage amount thereof in the modified polyester fiber is excessive. This shows that through controlling of the usage amount of polyamide-6 and the polyester masterbatch the modified polyester fiber can possess a good tensile strength, a good flexibility, and a good crease resistance. When the modified polyester fiber is applied to the mesh-shaped vertical drawing strap and the mesh-shaped inclined diaphragm of the inflatable bed, the inflatable bed can maintain a good connection and drawing function after being deflated, folded and inflated for many times.

Nano silica is replaces with the same usage amount of Nano-$TiO_2$ in the comparative example, the tensile strength and the elongation at fracture of the modified polyester fiber prepared were both decreased, and the tensile strength of the mesh woven was decreased, either, which indicated that Nano-$SiO_2$ and Nano-ZnO were added to the polyester masterbatch and the polyamide-6 in the present application, which can effectively improve the tensile strength and the flexibility of the polyester fiber, and further improve the tensile strength of the mesh woven.

Two Bromonium Salts with Octyl Groups were added as dispersant in the Comparative example 5, the tensile strength and the elongation at fracture of the modified polyester fiber prepared were both decreased, and the tensile strength of the mesh woven was decreased, probably because Bromonium Salts with Octyl Groups was combined with Long chain alkane pyridine hydrochloride, to act as dispersant, in particular, the Bromonium Salts with Octyl Groups can be combined with negative charge of the Nanofillers, which improves the dispersity, however the long chain of the long chain alkane pyridine hydrochloride is similar to polymer, which further improves the dispersity and compatibility of the Nanofillers in the polymer, so that the prepared modified polyester fibers have excellent and uniform tensile strength and flexibility.

The above are the preferred embodiments of the present application, which are not intended to limit the protection scope of the present application. Therefore, all equivalent changes made according to the structure, shape and principle of the present application should be covered within the protection scope of the present application.

LISTING OF REFERENCE SIGNS

1 side panel
2 face layer
3 mesh-shaped inclined diaphragm
31 first reinforcing sheet
32 second reinforcing sheet
41 inflating and deflating mouth
42 micropump for inflation and deflation
5 vertical drawing strap
51 third reinforcing sheet

What is claimed is:

1. An inflatable bed with a mesh-shaped inclined diaphragm, comprising a side panel and two face layers symmetrically arranged, a first end of the side panel is connected to a periphery of a first face layer of the two face layers, a second end of the side panel is connected to a periphery of a second face layer of the two face layers, wherein the inflatable bed with a mesh-shaped inclined diaphragm further comprises the mesh-shaped inclined diaphragm, a first end of the mesh-shaped inclined diaphragm is connected to the side panel, and a second end of the mesh-shaped inclined diaphragm is connected to one of the two face layers;

wherein the inflatable bed with a mesh-shaped inclined diaphragm further comprises a first reinforcing sheet, the first reinforcing sheet is connected to an inner surface of the side panel, and a first lateral edge of the mesh-shaped inclined diaphragm is arranged between the first reinforcing sheet and the inner surface of the side panel;

wherein the inflatable bed with a mesh-shaped inclined diaphragm further comprises a second reinforcing sheet, the second reinforcing sheet is connected to an inner surface of a respective one of the two face layers, and a second lateral edge of the mesh-shaped inclined diaphragm is arranged between the second reinforcing sheet and the inner surface of the respective one of the two face layers.

2. The inflatable bed with a mesh-shaped inclined diaphragm according to claim 1, wherein a quantity of the mesh-shaped inclined diaphragm is one.

3. The inflatable bed with a mesh-shaped inclined diaphragm according to claim 1, wherein the inflatable bed with a mesh-shaped inclined diaphragm further comprises a second mesh-shaped inclined diaphragm, the second end of the mesh-shaped inclined diaphragm is connected to the first face layer, a first end of the second mesh-shaped inclined diaphragm is connected to the side panel, and a second end of the second mesh-shaped inclined diaphragm is connected to the second face layer.

4. The inflatable bed with a mesh-shaped inclined diaphragm according to claim 1, wherein at least one of the side panel or the two face layers is provided with an inflating and deflating assembly.

5. The inflatable bed with a mesh-shaped inclined diaphragm according to claim 1, wherein a mesh-hole density of the mesh-shaped inclined diaphragm is 10-1000 mesh-holes/$dm^2$.

6. The inflatable bed with a mesh-shaped inclined diaphragm according to claim 1, wherein the mesh-shaped inclined diaphragm is made by cutting a mesh woven by a modified polyester fiber.

7. The inflatable bed with a mesh-shaped inclined diaphragm according to claim 6, wherein the modified polyester fiber is made by melting and spinning modified polyester fiber masterbatch, the modified polyester fiber masterbatch is made of the following raw materials in parts by weight: 55-70 parts of a polyester masterbatch, 8-12 parts of a polyamide-6, 5-8 parts of an ethylene-methyl acrylate copolymer, 3-6 parts of a nano silica, 1-3 parts of a nano zinc oxide, and 2-3 parts of a cation dispersant.

* * * * *